United States Patent [19]

Radoux et al.

[11] 4,245,982

[45] Jan. 20, 1981

[54] COOLING BOX FOR SHAFT FURNACES

[75] Inventors: Henri Radoux, Luxembourg; Carlo Heinz, Niederanven, both of Luxembourg; Herbert Ensch, Ghent; Guido Monteyne, Lembeke, both of Belgium

[73] Assignee: Paul Wurth S.A., Luxembourg

[21] Appl. No.: 45,171

[22] Filed: Jun. 4, 1979

[30] Foreign Application Priority Data

Jun. 12, 1978 [LU] Luxembourg ..... 79798

[51] Int. Cl.[3] ..... F27D 1/12; F22B 37/00; C21B 7/10

[52] U.S. Cl. ..... 432/233; 122/6 B; 122/6.5; 266/193

[58] Field of Search ..... 432/233, 238; 266/193, 266/194; 122/6 R, 6 B, 6.5

[56] References Cited

U.S. PATENT DOCUMENTS

| | | | |
|---|---|---|---|
| 3,679,194 | 7/1972 | Jones et al. | 432/238 X |
| 4,029,053 | 6/1977 | Higuchi | 122/6.5 |

*Primary Examiner*—John J. Camby

[57] ABSTRACT

The refractory lining of a shaft furnace is cooled by means of a cooling box, which extends into the lining through the furnace shell, having a pair of separately fed coolant flow paths formed therein. A first coolant circuit extends along the side walls of the cooling box and through the nose portion thereof while the second coolant circuit has a first portion which extends along the side walls adjacent the first circuit and a second portion which is disposed toward the center of the cooling box with respect to both the first cooling circuit and the first portion of the second cooling circuit.

10 Claims, 5 Drawing Figures

COOLING BOX FOR SHAFT FURNACES

BACKGROUND OF THE INVENTION (1) Field of the Invention:

The present invention relates to cooling the internal walls, and particularly the refractory lining, of shaft furnaces. More specifically, this invention is directed to cooling boxes intended for installation in the wall of a blast furnace. Accordingly, the general objects of the present invention are to provide novel and improved methods and apparatus of such character.

(2) Description of the Prior Art:

It is well known to provide the walls of blast furnaces with coolers through which cooling water is circulated in the interest of reducing the temperature of the furnace wall to thereby prolong its life. The typical shaft furnace wall has an outer steel shell and an inner lining of refractory material. The coolers are inserted through openings in the shell and into cavities formed in the refractory. In a modern furnace a great number of cooling box-type coolers will be fitted into the side wall of the furnace and will serve not only to cool the furnace but also to secure and support the refractory brickwork which defines the furnace lining. The cooling boxes are typically fabricated from copper or steel or may, in some cases, be comprised partly of copper and partly of steel. The typical prior art cooling box has a shape which is substantially that of a more or less flattened parallelopiped.

It is common for a cooling box to be provided with two cooling circuits; i.e., two separate flow paths through which cooling water may be circulated. Thus, in one type of prior art cooling box a first primary cooling circuit will extend along the external side walls of the cooling box into the "nose" portion thereof and a second cooling circuit will form a loop which is located in the cooling box to the inside of the first cooling circuit. The two cooling circuits are preferably separately fed with coolant whereby the second circuit may be kept in operation in the event of damage to the primary circuit. Damage to the externally positioned primary cooling circuit may result from wear of the "nose" portion of the cooling box; the "nose" portion of the cooling box being the most inwardly disposed part of the device and thus subject to the harshest operating conditions.

In actual practice, continuing to discuss prior art cooling boxes of the type having separately fed external primary and internal secondary cooling circuits, damage to the external primary cooling circuit requires that it be put out of operation. Termination of delivery of coolant to the external primary cooling circuit results in discontinuing the direct cooling of the peripheral portions of the cooling box and particularly of the side walls of the box. Accordingly, the erosion or other wear which resulted in the necessity of terminating operation of the external cooling circuit will continue at an increasing rate and will jeopardize the integrity of the internal or secondary cooling circuit. In this regard it is to be noted that the internal cooling circuit is generally designed to be less resistant to failure than the external circuit. Accordingly, at best, the provision of a pair of separate coolant flow loops in a conventional cooling box merely affords the furnace operator a short margin of time in which to replace a cooling box having a nose portion which has suffered wear.

It has been proposed to obviate the above discussed problem by providing a cooling box having a first or primary cooling circuit in the form of a loop which extends into the interior of the nose portion of the cooling box and which has two branches, functioning as the coolant supply and discharge conduits, arranged relatively close together and at the center of the cooling box at the end thereof which is adjacent the furnace-shell. The entire first cooling loop is immersed in a "second cooling circuit"; i.e., the interior of the cooling box is a cavity which functions as the "second cooling circuit". The coolant in the "second cooling circuit" is in contact with all of the walls of the cooling box with the exception of the nose portion thereof. In theory, upon failure of the first cooling circuit, the "second cooling circuit" would insure adequate cooling of the side walls of the cooling box after the cooling of the damaged nose portion of the box was discontinued. In actual practice, however, this desired effect does not result because the coolant will not circulate satisfactorily through the "second cooling circuit". There may, in fact, be stagnation regions or uncontrollable eddys in which the coolant does not circuiate at all. This results in the lateral surfaces, and even the upper and lower surfaces, of the cooling box not being properly cooled and this problem is aggravated after the first cooling circuit or loop has been put out of operation. Accordingly, cooling boxes which define a "second cooling circuit" in which a portion of the first cooling circuit is immersed have suffered from the same disadvantages as prior art cooling boxes including separately fed coolant flow paths which define primary external and secondary internal cooling circuits.

SUMMARY OF THE INVENTION

The present invention overcomes the above-discussed and other deficiencies and disadvantages of the prior art by providing an improved cooling box design wherein a pair of separately fed cooling circuits are included within the box and wherein coolant flow throughout substantially the entire cooling box is insured even after the cooling circuit which extends the furthest into the nose of the box has become inoperative.

A cooling box in accordance with a preferred embodiment of the present invention is characterized by a pair of separately fed cooling circuits wherein a secondary circuit is arranged such that it extends partly along the external side walls of the box, where it is adjacent to the primary cooling circuit, and partly in the central region of the box, wherein it doubles back on itself and is also positioned inwardly with respect to a portion of the primary cooling circuit.

In one particularly advantageous version of the present invention, the secondary cooling circuit is in the form of a U-shaped double loop and the coolant is delivered into the outer loop and is discharged from the cooling box via the inner loop.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENT

Figure 1:
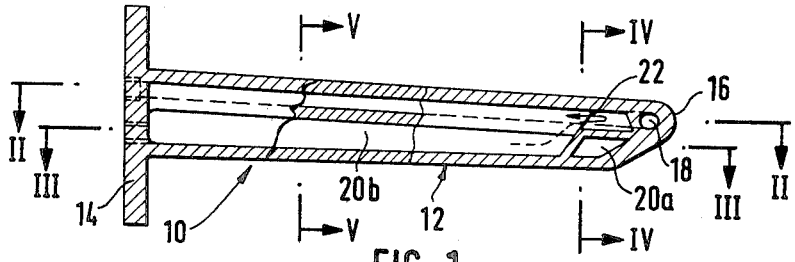
FIG. 1 is a schematic cross-sectional side elevation view of a cooling box in accordance with a first embodiment of the present invention.

With reference now to the drawing, a cooling box in accordance with a first embodiment of the present invention has been indicated generally at 10. Cooling box 10 consists essentially of a caisson 12 which penetrates the refractory lining of a furnace wall in a substantially horizontal direction; i.e., the cooling box would be installed in a furnace wall with the orientation shown in FIG. 1. The caisson 12 is integral with a wall plate 14 whereby the cooling box will be affixed to external metal shell of a furnace. As may be seen from joint consideration of FIGS. 1, 4 and 5, the caisson 12 has an elongated flat shape which terminates in a bevelled nose portion 16. The nose 16 of the cooling box is the portion thereof which penetrates the furthest into the furnace wall and thus is the portion which is subjected to the severest operating conditions.

A first or primary cooling circuit 18 is in the form of a U-shaped loop through the upper peripheral region of caisson 12 as may be seen from joint consideration of FIGS. 1, 2, 4 and 5. Cooling circuit 18 is supplied with a suitable coolant via connections, not shown in the drawing, and the base of the loop extends into the extreme tip of the nose portion 16 of caisson 12.

Figure 3:
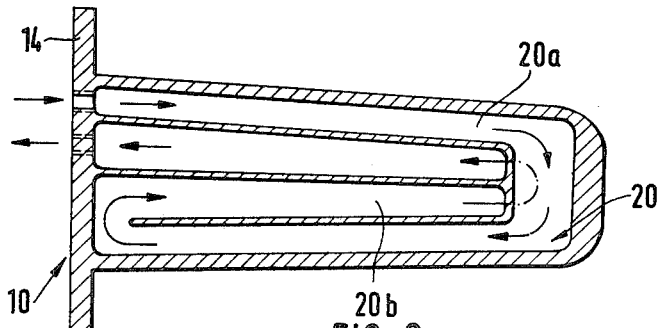
FIG. 3 is a schematic view taken along line III—III of FIG. 1.

The secondary cooling circuit 20 is in the form of a double U-shaped loop and has portions thereof disposed both inwardly of and beneath the first cooling circuit 18. The configuration of secondary cooling circuit 20 may be seen from consideration of all of the FIGURES of the drawing with particular emphasis being on FIG. 3. Cooling circuit 20 comprises a U-shaped outer branch **20*a* and a U-shaped inner branch 20*b*. The branches 20*a* and 20*b* of cooling circuit 20 are connected in series. Cooling circuit 20 is also connected to a coolant source by means of suitable connections, not shown in the drawing, and the coolant circulates through circuit 20 in the direction indicated by the arrows on FIG. 3**.

With the exception of the region of the nose 16 of caisson 12, where the course taken by branch **20*a* of the secondary cooling circuit is slightly set back with respect to first cooling circuit 18, branch 20*a* extends along the peripheral region of caisson 12 where it is positioned adjacent to the primary cooling circuit 18 and also adjacent to the side walls of the cooling box. This arrangement may best be seen from FIG. 5. Consequently, the lateral wall portions of the caisson 12 are cooled by the combined action of coolant flow through primary cooling circuit 18 and branch 20*a* of the secondary cooling circuit 20. The tip of nose portion 16 of caisson 12 is cooled primarily by coolant flow through primary circuit 18**.

Figure 2:
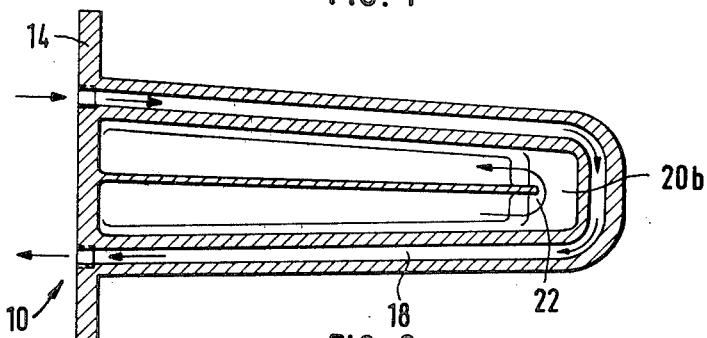
FIG. 2 is a schematic view taken along line II—II of FIG. 1.

Referring to FIGS. 1 and 2, it may be seen that the inwardly disposed branch **20*b* of secondary cooling circuit 20, like branch 20*a*, extends as far as possible into the region of the nose 16 of caisson 12. In order for this to be accomplished the base portion of the U-shaped loop 20*b* has a reduced cross-sectional area in the region of nose 16 in order to enable branch 20*b* to cross over branch 20*a*. This cross-over portion may best be seen from FIG. 1**.

The above-described arrangement of the primary and secondary cooling circuits, respectively 18 and 20, improves the efficiency of the cooling box and increases its service life. If the primary cooling circuit 18 fails, as a result of wear suffered by the nose portion 16 of the cooling box, whereby circulation of coolant through circuit 18 must be terminated, the secondary cooling circuit 18 will continue to insure effective cooling of the outer parts of caisson 12 along the lateral portions thereof because of the positioning of branch **20*a* of the secondary cooling circuit. When the continued cooling of the lateral wall of caisson 12, resulting from the flow of coolant through branch 20*a* of secondary cooling circuit 20, the rate at which the wear suffered by the refractory brickwork of the furnace continues in the region between the cooling boxes will be slowed even after the primary cooling circuit 18** has become inoperative.

Figure 4:
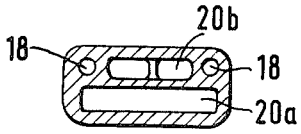
FIG. 4 is a cross-sectional view taken along line IV—IV of FIG. 1.
Figure 5:
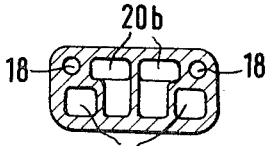
FIG. 5 is a cross-sectional view taken along line V—V of FIG. 1.

A particular advantage of a cooling box in accordance with the present invention resides in the fact that the arrangement of cooling circuits described above permits the exercise of control over and verification of the speed of flow of the coolant in the two circuits. The continuity and shape of the two separate cooling circuits prevents the creation of stagnation points. Furthermore, the cross-section of the two circuits enables the circulation velocity to be determined, and the rate of heat exchange to be increased or reduced in accordance with furnace requirements, since the cooling capacity is proportional to the speed of circulation of the coolant. Thus, as shown in FIG. 5, the cross-section of the internal branch **20*b* of the secondary cooling circuit 20 is greater than that of the external branch 20*a*. This, of course, is desirable since the cooling capacity of the external branch 20*a* must be greater than that of the internal branch 20*b* and thus faster flow through branch 20*a* is desired. Similarly, as shown in FIG. 4 the base portion of the branch 20*b* of the secondary cooling circuit has a much smaller cross-sectional area than remaining portions of branch 20*b* whereby the speed of flow of coolant, and consequently the cooling capacity, is increased in the base area of U-shaped branch 20*b*. It is also to be noted that the cross-section of the base portion of branch 20*b* of secondary cooling circuit 20 may be varied in accordance with design requirements by lengthening or shortening the dividing wall 22 which defines the two legs of secondary cooling circuit branch 20*b***.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In a cooling box for a shaft furnace, the cooling box being in the form of a housing having a nose portion, the cooling box having fluidically isolated primary and secondary coolant flow circuits disposed therein, the primary coolant circuit being juxtapositioned to a pair of oppositely disposed side walls of the cooling box and extending into the nose portion thereof, the improvement comprising:

a first part of the secondary cooling circuit being positioned along and in direct heat transfer relationship with each of the side walls of the cooling box, said first part of the said secondary cooling circuit also being adjacent to at least partly extending parallelly with a portion of the primary cooling circuit, a second part of the secondary cooling circuit being positioned inwardly toward the central region of the cooling box with respect to both the primary circuit and the said first part of the secondary circuit, said first and second part of the secondary circuit being connected in series.

2. The apparatus of claim 1 wherein said secondary circuit comprises a pair of generally U-shaped coolant flow paths.

3. The apparatus of claim 2 wherein the coolant is delivered to the first part of the secondary circuit and discharged from the second part of the secondary circuit.

4. A cooling box for a shaft furnace comprising: caisson means, said caisson means having a generally flat elongated shape and a pair of oppositely disposed side walls, a first end of said caisson means having a bevelled portion which terminates in a nose;

a wall plate, said wall plate extending from the second end of said caisson means, the cooling box being mounted in a furnace by means of said plate;

means defining a primary coolant flow passage through said caisson means, said primary coolant flow passage extending along the side walls of said caisson means to the nose thereof whereby coolant may be passed along a first side wall of the caisson means through the nose and then along the second side wall; and means defining a secondary coolant flow path in said caisson means, said secondary flow path having a first portion extending along said side walls adjacent and at least partly in parallel with a portion of said primary coolant flow passage, said first portion of said secondary coolant flow path being in part in direct heat transfer relationship with said side walls, said secondary flow path defining means further having a second portion extending through the central region of said caisson means, said second portion of said secondary flow path defining means being at least in part disposed inwardly with respect to both of said primary flow passage defining means and the first portion of said secondary flow path defining means, said first and second portions of said secondary flow path defining means being connected in series.

5. A cooling box in accordance with claim 4 wherein said secondary coolant flow path defining means comprises a pair of generally U-shaped passages, said passages each having a base portion and a pair of legs which extend therefrom toward the second end of said caisson means.

6. A cooling box in accordance with claim 5 wherein the coolant is delivered to the first portion of the secondary coolant flow path defining means and is discharged from the second portion thereof.

7. The cooling box of claim 6 wherein said secondary coolant flow path defining means includes a dividing wall having a first end affixed to the second end of said caisson means, said dividing wall extending from the second end of said caisson means toward the nose thereof, said dividing wall cooperating with a recess in said caisson means to define the second of said U-shaped passages, the cross-sectional area of the base portion of said second U-shaped passage being determined by the space between the second end of said dividing wall and the base of the recess.

8. A cooling box in accordance with claim 7 wherein the base portion of said U-shaped second portion of said secondary coolant flow path defining means crosses over the base portion of the U-shaped first portion of said secondary coolant flow path defining means.

9. A cooling box in accordance with claim 6 wherein the base portion of said U-shaped second portion of said secondary coolant flow path defining means crosses over the base portion of the U-shaped first portion of said secondary coolant flow path defining means.

10. A cooling box in accordance with claim 5 wherein the base portion of said U-shaped second portion of said secondary coolant flow path defining means crosses over the base portion of the U-shaped first portion of said secondary coolant flow path defining means.

* * * * *